US008505448B2

(12) United States Patent
Ko

(10) Patent No.: US 8,505,448 B2
(45) Date of Patent: Aug. 13, 2013

(54) STRUCTURE OF TRASHCAN

(76) Inventor: Wen-Hsiung Ko, Taichung (TW)

( * ) Notice: Subject to any disclaimer, the term of this patent is extended or adjusted under 35 U.S.C. 154(b) by 0 days.

(21) Appl. No.: 13/209,113

(22) Filed: Aug. 12, 2011

(65) Prior Publication Data

US 2013/0037547 A1 Feb. 14, 2013

(51) Int. Cl.
*B30B 15/04* (2006.01)

(52) U.S. Cl.
USPC ..... 100/229 A; 100/59; 100/61; 100/227; 100/266; 220/908

(58) Field of Classification Search
USPC ..... 100/59, 61, 226, 227, 229, 229 A, 100/245, 246, 247, 265, 266; 220/263, 578, 220/908
See application file for complete search history.

(56) References Cited

U.S. PATENT DOCUMENTS 2,384,709 A * 9/1945 Thoren ..... 220/495.08
4,765,579 A * 8/1988 Robbins et al. ..... 248/101
6,910,412 B2 * 6/2005 Ko ..... 100/229 A
6,983,685 B2 * 1/2006 Ko ..... 100/229 A
7,874,446 B2 * 1/2011 Spivey et al. ..... 220/254.3
2008/0000912 A1 * 1/2008 Lin ..... 220/495.08

FOREIGN PATENT DOCUMENTS

TW 587628 5/2004

* cited by examiner

*Primary Examiner* — Jimmy T Nguyen
(74) *Attorney, Agent, or Firm* — Wang Law Firm, Inc.; Li K. Wang; Stephen Hsu

(57) ABSTRACT

An improved structure of trashcan includes an outer can with a controllable upper cover. The upper cover has a connecting hole with a stepping part that moves downward in the outer can when being stepped. A base is at the bottom of the upper cover. First, second, third, and fourth tracks surround the stepping part at symmetrical positions of the base. Each track accommodates a restoring assembly that connects to the stepping part so that the stepping part can restore its original position after the stepping part moves to the bottom of the trashcan. The first track and the second track are stacked vertically. The third track and the fourth track are also stacked vertically. This configuration decreases the area occupied by the base. As a result, the stepping area of the stepping part is increased for the user's convenience to step on.

4 Claims, 7 Drawing Sheets

STRUCTURE OF TRASHCAN

BACKGROUND OF THE INVENTION

1. Field of Invention

The invention relates to a trashcan and, in particular, to an improved trashcan that has a stepping part for compressing the trash volume.

2. Related Art

A conventional trashcan that can compress the trash volume is shown in FIGS. 6 and 7. It has an upper cover 7 whose center has a connecting hole 71 provided with a stepping board 72. The stepping board 72 is connected to the upper cover 7 by a restoring assembly 73. When one steps on the stepping board 72, the stepping board 72 moves downward inside the trash can to compress the trash volume. The restoring assembly 73 then returns the stepping board 72 to its original position.

The restoring assembly 73 includes four elastic elements 74 in four tracks 75 surrounding and at the bottom of the upper cover 7. One end of each of the elastic elements 74 is connected to one of the four symmetric positions at the bottom of the upper cover 7, respectively. The other end thereof is connected to a transmission element 76. Each of the transmission elements 76 extends along the corresponding track 75 and winds around a pulley 77 provided on the corresponding track 75. Each of the transmission elements therefore redirects and goes through a through hole 78 formed on the corresponding track 75, connecting to the stepping board 72. When the stepping board 72 is stepped to the bottom of the trashcan, it can be restored to its original position by the elastic elements 74.

However, the tracks 75 around the bottom of the upper cover 7 for accommodating the elastic elements 74 reduce the stepping area of the stepping board 72, thus resulting in some inconvenience in usage. Moreover, most of conventional trashcans have an elliptical shape. The pivotal connecting place between the upper cover 7 and the trashcan body is at the end point of the long axis of the ellipse. As a result, when one opens the upper cover 7, the entire trashcan may topple due to the instability in the weight center thereof. This is very annoying.

SUMMARY OF THE INVENTION

One objective of the invention is to provide an improved trashcan structure. The tracks for accommodating the restoring assemblies are arranged in the vertical direction. This enlarges the stepping area of the stepping part, thus more convenient to use.

Another objective of the invention is to provide an improved trashcan structure whose pivotal connection between the upper cover and the trashcan body is on the long edge of the opening of the trashcan. Therefore, the trashcan is unlikely to topple when one opens the upper cover.

To achieve the above-mentioned objectives, the disclosed trashcan structure includes an outer can. The outer can has an accommodating space with an upward opening. The outer can accommodates an inner tube that is penetrated through in the vertical direction. A trash bag is disposed between the outer can and the inner tube. The inner tube urges the trash bag against the inner wall of the outer can. The top of the outer can is pivotally provided with a controllable upper cover. The center of the upper cover has a connecting hole provided with a stepping part. The stepping part can move vertically back and forth inside the accommodating space. The bottom of the upper cover has a base around the connecting hole. The base is formed with a first track, a second track, a third track, and a fourth track symmetrically around the connecting hole. A restoring assembly is disposed in each of the tracks and connected to the stepping part, so that the stepping part can return to its original position once it moves to the bottom of the trashcan.

The restoring assembly includes an elastic element, a transmission element, and a pulley. The pulley is fixed on the corresponding track. A downward through hole is formed on the track near the pulley. One end of the elastic element is fixed on the corresponding track, whereas the other end is connected to the transmission element. The transmission element extends along the track and winds around the pulley. The transmission element then penetrates through the through hole and connects to the stepping part. In particular, the first track and the second track are arranged vertically, and the third track and the fourth track are also arranged vertically.

BRIEF DESCRIPTION OF THE DRAWINGS

These and other features, aspects and advantages of the invention will become apparent by reference to the following description and accompanying drawings which are given by way of illustration only, and thus are not limitative of the invention, and wherein.

DETAILED DESCRIPTION OF THE INVENTION

Figure 1:
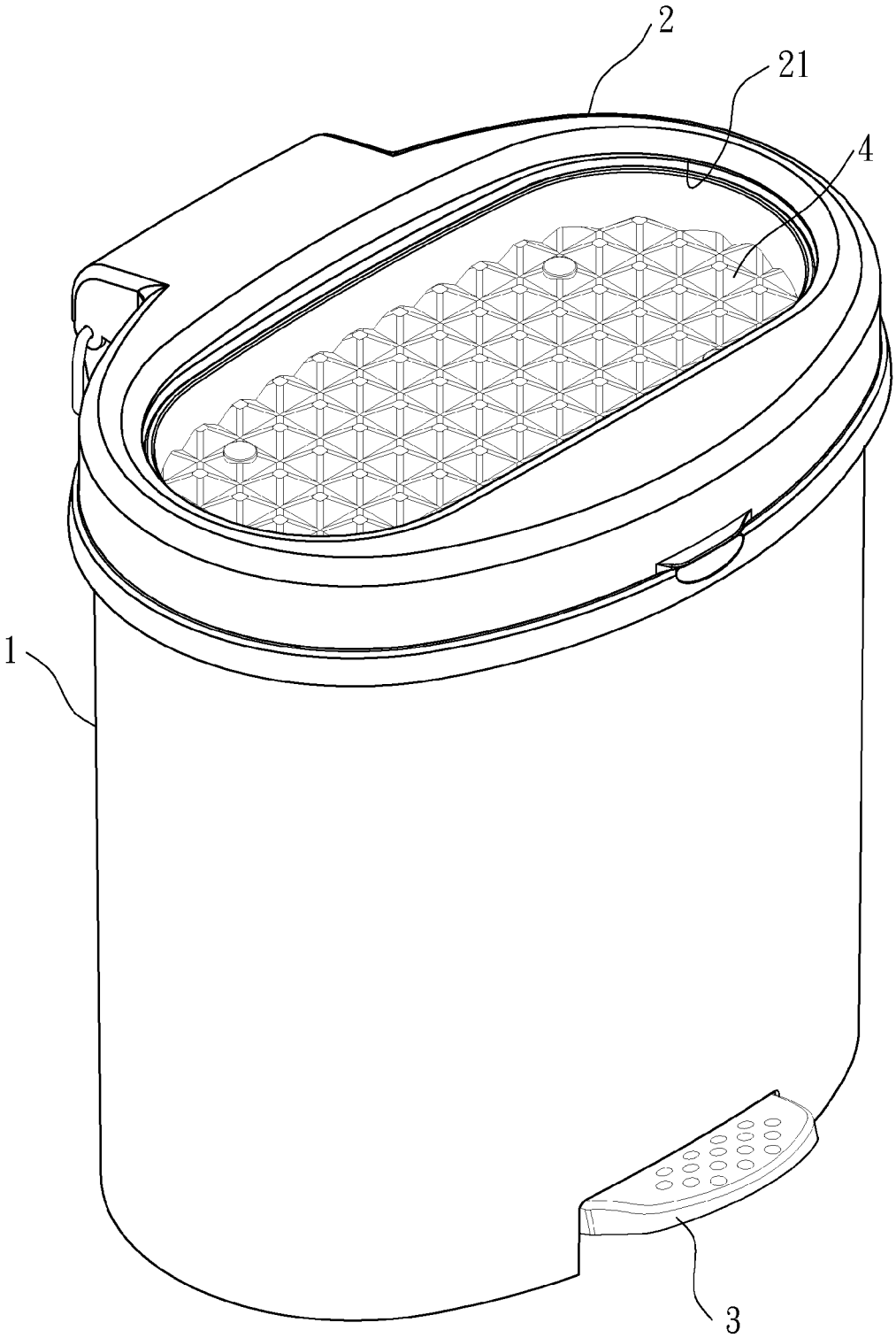
FIG. 1 is a three-dimensional assembly view of the invention.
Figure 2:
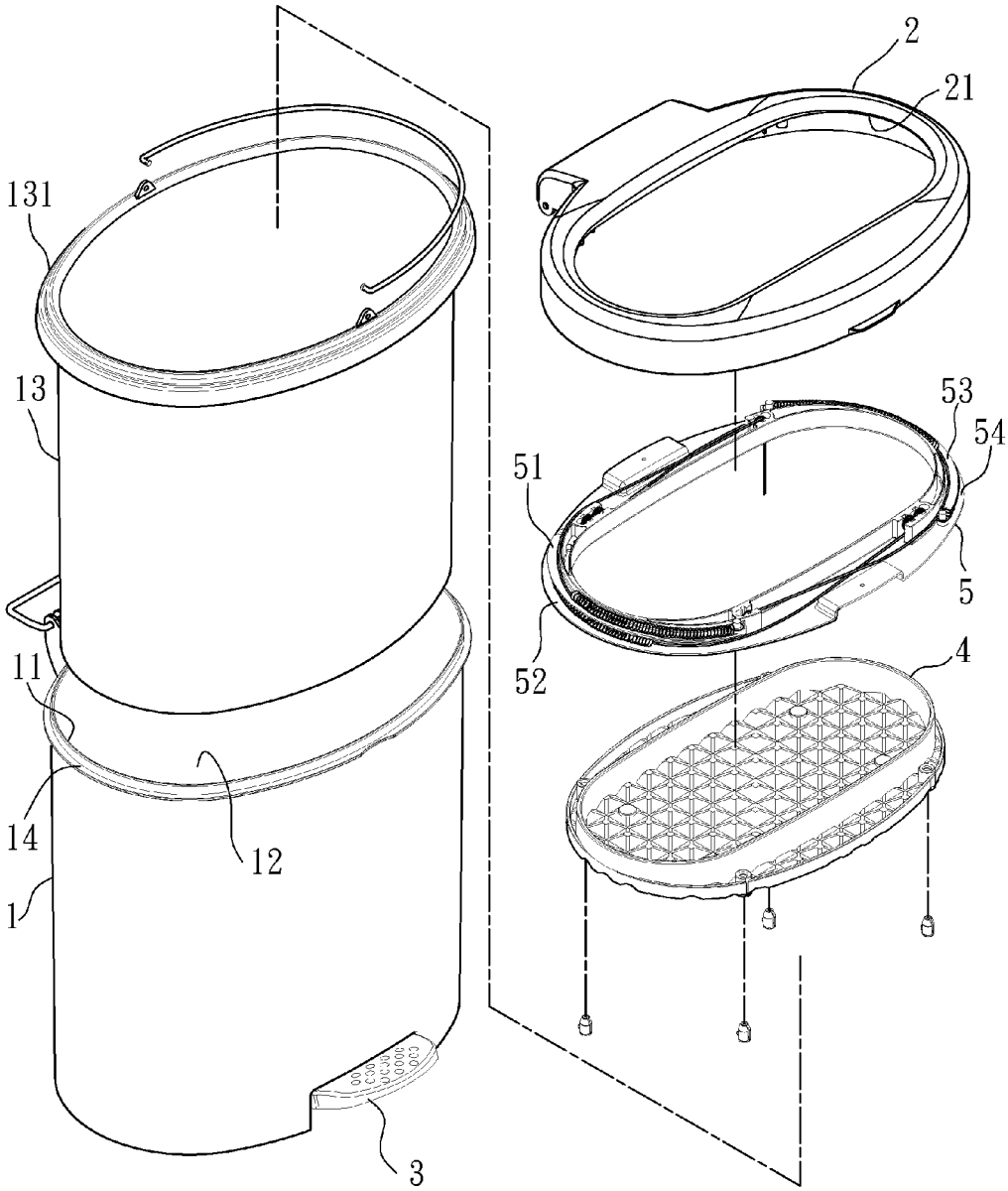
FIG. 2 is a three-dimensional exploded view of the invention.

The present invention will be apparent from the following detailed description, which proceeds with reference to the accompanying drawings, wherein the same references relate to the same elements.

Please refer to FIGS. 1 to 5 for an improved structure of trashcan. The structure includes a roughly elliptical outer can 1 that has an accommodating space 12 with an upward opening 11. The long side of the opening 11 is pivotally installed with an upper cover 2. The openness of the upper cover 2 is controlled by a stepping board 3 provided at the bottom of the outer can 1 and a connecting bar (not shown) pivotally connected to the stepping board 3 and the upper cover 2. Since the upper cover 2 is pivotally connected to a long side of the opening 11 of the outer can 1, the trashcan is unlikely to topple when the upper cover 2 is open.

Figure 3:
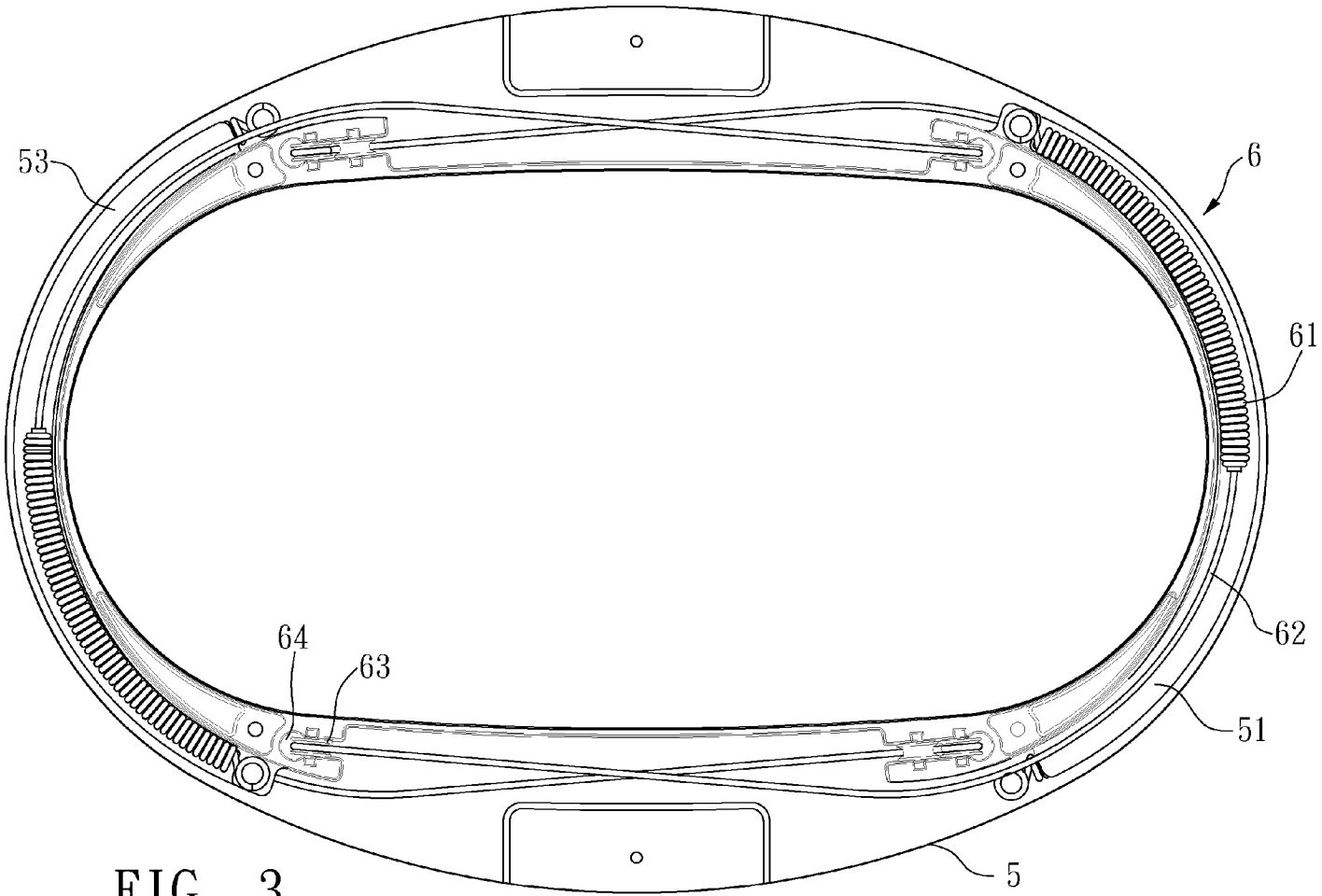
FIG. 3 is a top view of the disclosed base, showing that each pair of tracks are disposed in a stack and that the stepping area of the stepping part is larger.
Figure 4:
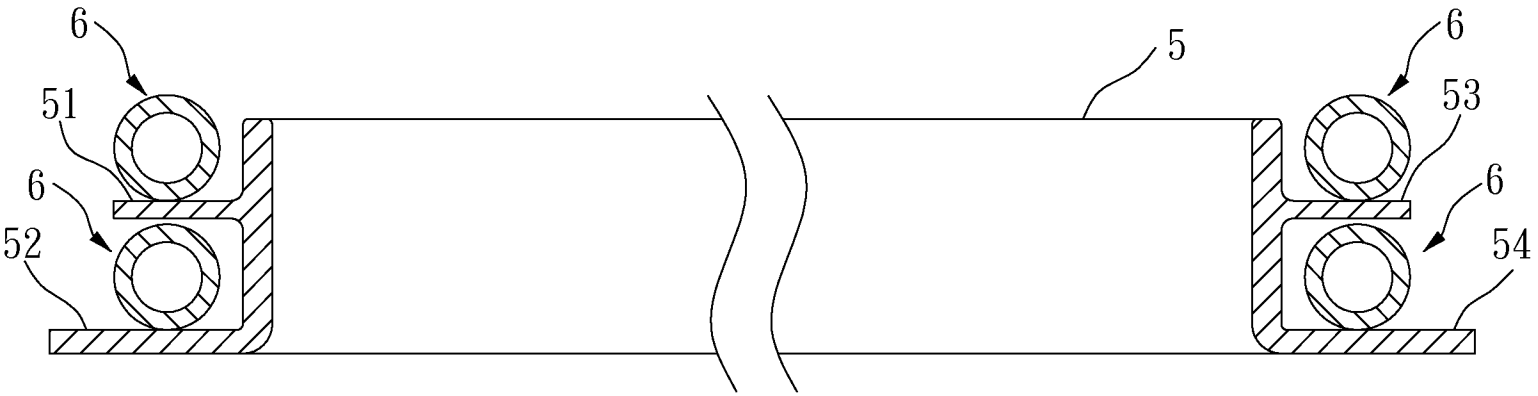
FIG. 4 is a cross-sectional view of the disclosed base.

The center of the upper cover 2 has a connecting hole 21 with a stepping part 4. The stepping part 4 can move vertically and reciprocally in the accommodating space 12. The bottom of the upper cover 2 has a base 5 around the connecting hole 21. As shown in FIGS. 3 and 4, a first track 51, a second track 52, a third track 53, and a fourth track 54 surround the connecting hole 21 at symmetrical positions of the base 5. The first track 51 and the second track 52 are disposed vertically, and the third track and the fourth track 54 are disposed vertically as well. In comparison with the prior art, the tracks 51, 52, 53, 54 on the disclosed base stack on each other in pairs, thereby reducing the area occupied by the tracks on the cover. This also relatively enlarges the outer diameter of the connecting hole 21, thus increasing the area of the stepping part 4 in the connecting hole 21. The user can more easily step on the stepping part 4 to compress the trash volume in the trashcan.

Figure 5:
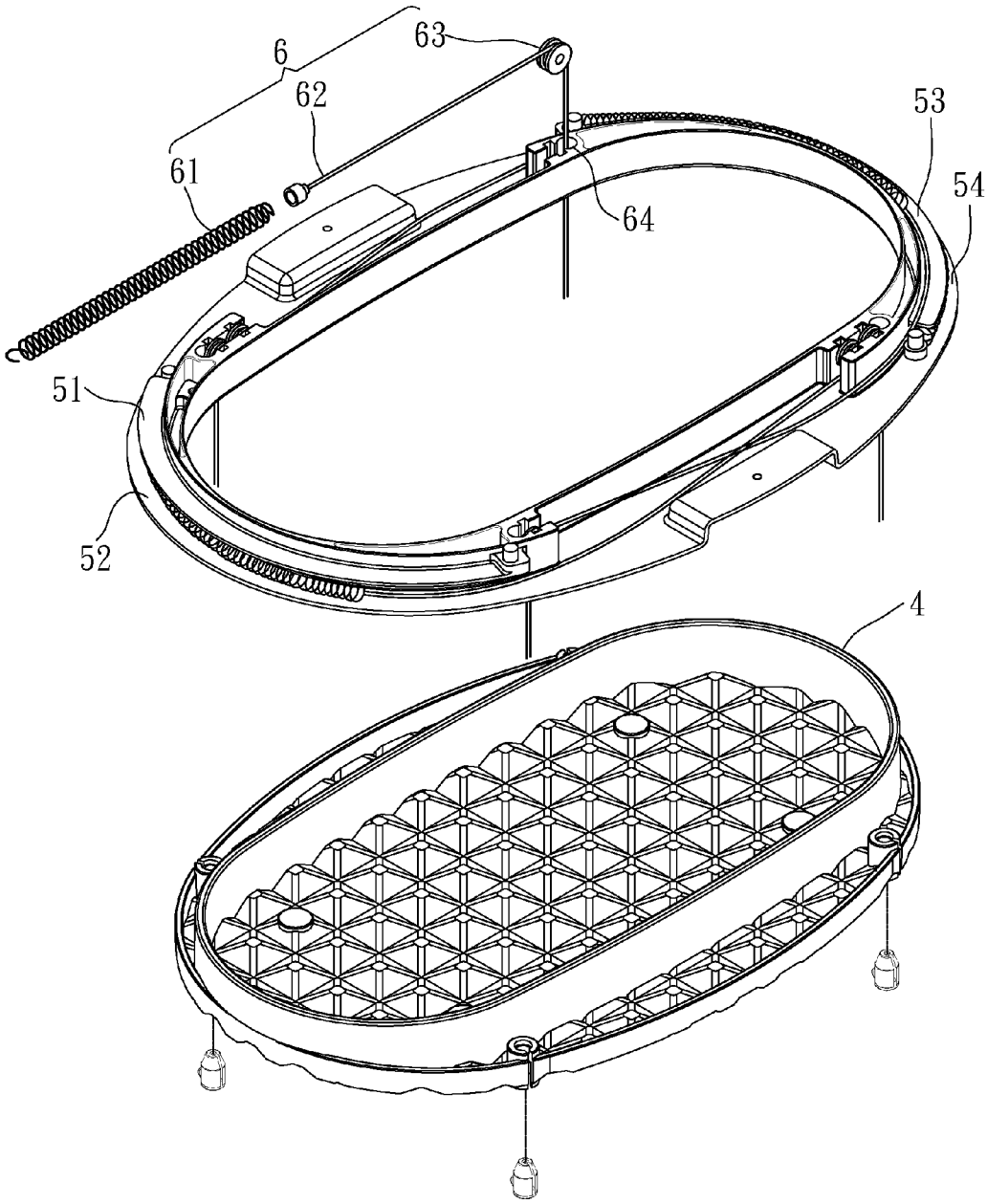
FIG. 5 is an exploded view of the disclosed restoring assembly.
Figure 6:
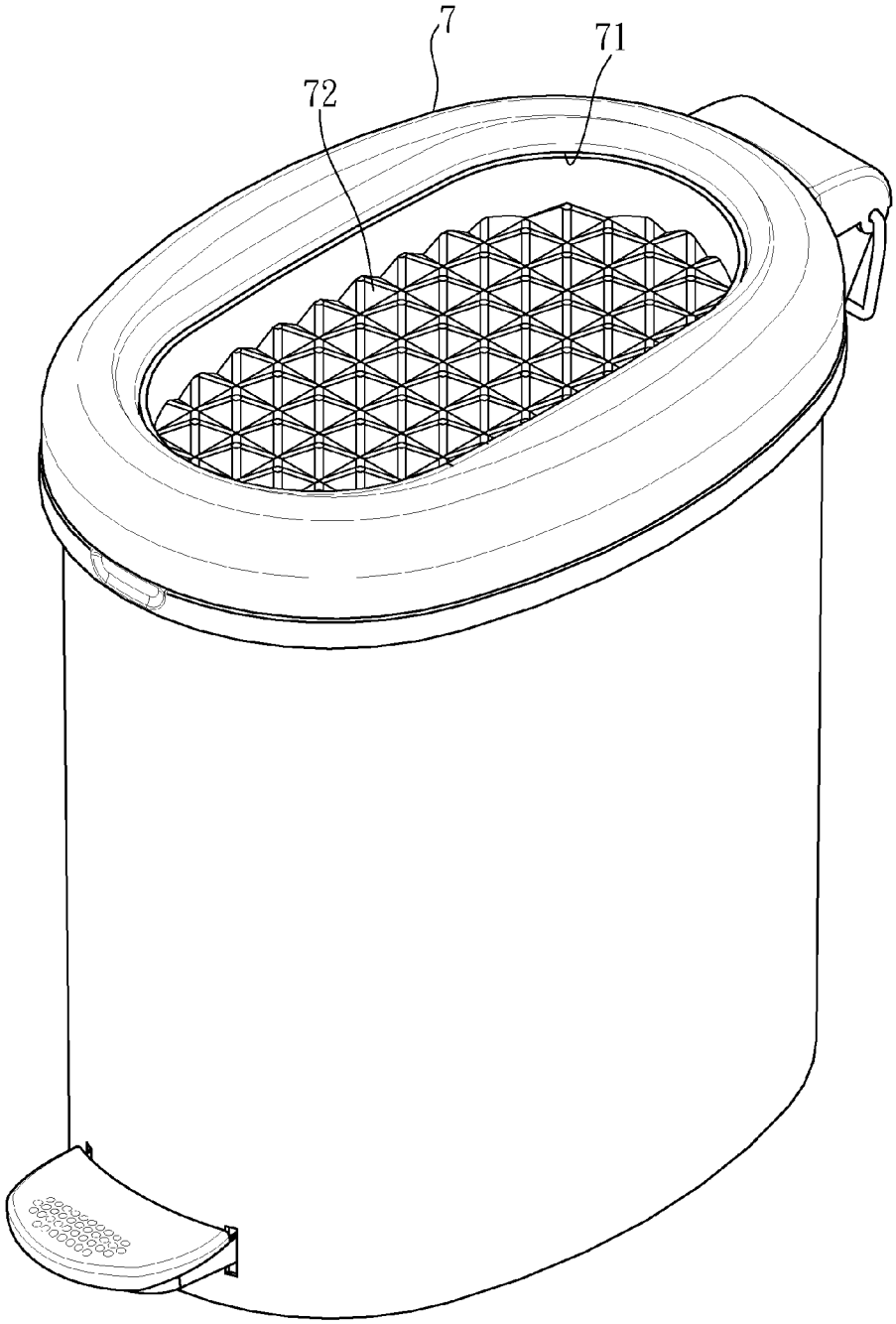
FIG. 6 PRIOR ART
FIG. 6 is a three-dimensional assembly view of a conventional trashcan.
Figure 7:
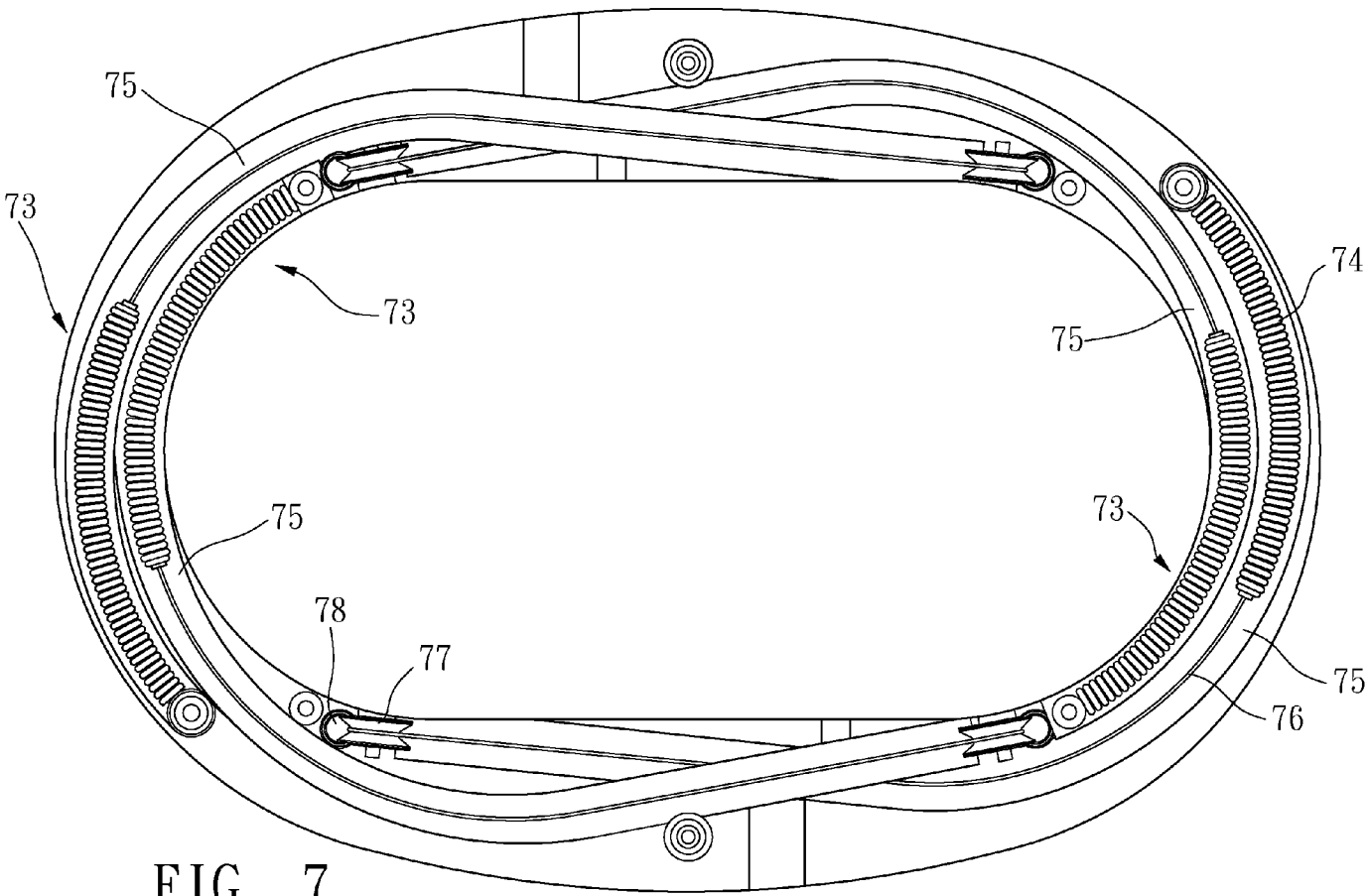
FIG. 7 PRIOR ART
FIG. 7 is a top view of the base of a conventional trashcan.

As shown in FIG. 5, each of the tracks 51, 52, 53, 54 accommodates a restoring assembly 6 that connects to the stepping part 4. Therefore, after the stepping part 4 moves to the bottom of the accommodating space 12, it can return to its original position. The restoring assembly 6 includes an elastic element 61, a transmission element 62, and a pulley 63. The pulley 63 is fixed on the corresponding track. A through hole 64 is formed downward on the track near the pulley 63. One end of the elastic element 61 is fixed on the corresponding track, whereas the other end is connected to the transmission element 62. The transmission element 62 extends along the corresponding track and winds around the pulley 63 before it goes downward through the through hole 64 and connects to the stepping part 4. Therefore, the stepping part 4 being stepped to the bottom of the accommodating space 12 can be restored to its original position by the elasticity of the elastic elements 61.

Besides, the outer can 1 accommodates an inner tube 13 penetrated through vertically. A trash bag is disposed between the outer can 1 and the inner tube 13. The inner tube 13 urges the trash bag to the inner wall of the outer can 1. This structure prevents the trash bag from being torn when the stepping part 4 compresses the trash volume. Moreover, a locking part 14 is extended outward from the surrounding of the opening 11 of the outer can 1. The surrounding of the top end of the inner can 13 is also extended outward with a hooking part 131 corresponding to the locking part 14. When the inner tube 13 is disposed in the outer can 1, the hooking part 131 engages with the locking part 14 so that the trash bag opening is fixed.

Although the invention has been described with reference to specific embodiments, this description is not meant to be construed in a limiting sense. Various modifications of the disclosed embodiments, as well as alternative embodiments, will be apparent to people skilled in the art. Therefore, it is contemplated that the appended claims will cover all modifications that fall within the true scope of the invention.

What is claimed is:

1. An improved trashcan structure, comprising:

an outer can having an accommodating space with an upward opening and accommodating an inner tube that vertically penetrates the outer can, wherein a trash bag is disposed between the outer can and the inner tube and urged by the inner tube against the inner wall of the outer can;

a controllable upper cover pivotally installed on the top of the outer can, the center of the upper cover having a connecting hole provided with a stepping part that moves vertically and reciprocally from an original position in the accommodating space when stepped by a user;

a base provided at the bottom of the upper cover and around the connecting hole, wherein a first track, a second track, a third track, and a fourth track are disposed around the connecting hole at symmetrical positions of the base;

a restoring assembly accommodated in each of the tracks and connecting to the stepping part so as to provide a restoring force for returning the stepping part to its original position after moving to the bottom of the accommodating space;

wherein the restoring assembly includes:

an elastic element;

a transmission element; and a pulley;

wherein the pulley is fixed to the corresponding track, a through hole is formed downward on the track near the pulley, one end of the elastic element is fixed to the corresponding track and the other end is connected to the transmission element, the transmission element extends along the track and winds around the pulley then goes downward through the through hole and connects to the stepping part;

wherein the first track and the second track are stacked vertically as pairs, and the third track and the fourth track are stacked vertically as pairs, such that the first track and its corresponding elastic element are disposed above the second track and its corresponding elastic element, and the third track and its corresponding elastic element are disposed above the fourth track and its corresponding elastic element.

2. The improved trashcan structure of claim 1, wherein the bottom of the outer can is provided with a stepping board pivotally connected with a connecting bar that pivotally connects to the upper cover, thereby controlling the upper cover.

3. The improved trashcan structure of claim 1, wherein the upper cover pivotally connects to the side of the longer edge of the opening at the top of the outer can.

4. The improved trashcan structure of claim 1, wherein a locking part extends outward from the surrounding of the opening of the outer can and a hooking part corresponding to the locking part extends outward from the surrounding of the top of the inner tube, so that the hooking part and the locking part engage with each other to fix the trash bag opening when the inner tube is disposed in the outer can.

* * * * *